US006360714B1

(12) United States Patent
Kotooka et al.

(10) Patent No.: US 6,360,714 B1
(45) Date of Patent: Mar. 26, 2002

(54) FUEL INJECTOR

(75) Inventors: Seijiro Kotooka, Yokohama; Susumu Kohketsu, Tokyo; Keiki Tanabe, Yokohama, all of (JP)

(73) Assignee: Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 09/596,528

(22) Filed: Jun. 19, 2000

(30) Foreign Application Priority Data

Jun. 18, 1999 (JP) ..... 11-173275
Jun. 18, 1999 (JP) ..... 11-173277
Jun. 18, 1999 (JP) ..... 11-173278

(51) Int. Cl.[7] ..... F02B 3/00; F02B 23/00
(52) U.S. Cl. ..... 123/299; 123/575
(58) Field of Search ..... 123/299, 300, 123/575, 576, 577, 456, 446, 578

(56) References Cited

U.S. PATENT DOCUMENTS 4,628,881 A * 12/1986 Beck et al. ..... 123/447
4,705,010 A * 11/1987 Baranescu ..... 123/575
5,163,397 A * 11/1992 Pien ..... 123/299
6,067,964 A * 5/2000 Ruoff et al. ..... 123/467
6,273,032 B1 * 8/2001 Ruoff et al. ..... 123/25 R

FOREIGN PATENT DOCUMENTS

JP 4-19354 1/1992

* cited by examiner

*Primary Examiner*—Carl S. Miller
(74) *Attorney, Agent, or Firm*—Rossi & Associates

(57) ABSTRACT

A fuel injector to be used with a low-pressure fuel source and a high-pressure fuel source to provide a two-stage fuel injection has superior responsiveness of fuel pressure control and ease of mounting to an engine. The fuel injector has a housing mounted to a cylinder head of an engine; a fuel injection valve fitted in a first end of the housing and having a first control valve for controlling injection of fuel to a combustion chamber of the engine; a first conduit formed in the housing and having one end connecting with the fuel injection valve and its other end opening in a second end of the housing and connected to a high-pressure fuel source storing high-pressure fuel; a second control valve, fitted to the housing, for controlling a supply of high-pressure fuel to the fuel injection valve by opening and closing the first conduit; a second conduit formed in the housing and having one end connecting with the first conduit downstream of the second control valve and its other end opening in the housing and connected to a low-pressure fuel source storing low-pressure fuel at a low-pressure than the fuel pressure of the high-pressure fuel source; and a check valve fitted in the housing and being disposed to the second conduit, for allowing the inflow of low-pressure fuel from the low-pressure fuel source to the first conduit side. As a result, the dead volume between the second control valve, the check valve and the fuel injection valve is minimized and the responsiveness of fuel pressure control can be improved.

10 Claims, 6 Drawing Sheets

FUEL INJECTOR

BACKGROUND OF THE INVENTION

1. Field of the Invention

This invention relates to a fuel injector, and particularly to a pressure accumulator type fuel injector having superior responsiveness of fuel pressure control.

2. Prior Art

To improve engine performance over a wide engine operating range extending from low speeds to high speeds, diesel engines have been fitted with pressure accumulator type fuel injection systems (common rail systems) capable of supplying high-pressure fuel stored in an accumulator in a stable manner to each cylinder of the engine.

However, even when this kind of fuel injection system is used, sudden explosive combustion occurs near the start of combustion when the fuel injection rate immediately after the start of fuel injection in the fuel injection cycle is excessively large, which results not only in an increase in engine noise, but also in an increase in the amount of oxides of nitrogen (NOx) in the exhaust gas.

To eliminate this kind of problem, common rail fuel injection systems which start fuel injection at a somewhat low fuel injection rate in an initial stage of the fuel injection cycle have been proposed.

As shown in FIG. 7, this kind of common rail fuel injection system 1 has a high-pressure common rail 2 storing high-pressure fuel pressurized by a fuel pump 1*a*, a low-pressure common rail 7 storing fuel at a lower pressure than the high-pressure fuel in the high-pressure common rail 2, and a fuel injection valve 3 for injecting high-pressure fuel from the high-pressure common rail 2 and low-pressure fuel from the low-pressure common rail 7 into a combustion chamber of the engine. The fuel injection valve 3 is connected to the high-pressure common rail 2 by a fuel supply pipe 11. The fuel injection valve 3 has inside it a pressure control chamber 3*a* and a fuel chamber 3*b* connected to the fuel supply pipe 11, and has a closing valve 15 for fuel injection timing control interposed between the pressure control chamber 3*a* and a fuel discharge conduit (not shown).

A pressure-switching valve 4 is provided in the fuel supply pipe 11, and a branch fuel pipe 12 branches from the fuel supply pipe 11 on the downstream side of this pressure-switching valve 4. The branch fuel pipe 12 includes two mutually parallel conduit sections, in one of which an orifice 5 is disposed and in the other of which a check valve 6 is disposed, and the low-pressure common rail 7 is connected to the fuel supply pipe 11 by this branch fuel pipe 12. Also, an electromagnetic pressure control valve 8 for controlling the fuel pressure of the low-pressure common rail 7 to a predetermined fuel pressure lower than that of the high-pressure fuel in the high-pressure common rail 2 is provided in a fuel return pipe 7*a* extending between the low-pressure common rail 7 and a fuel tank 10.

The check valve 6 thus has one side connected to the low-pressure common rail 7 and the other side connected by the branch fuel pipe 12 to the fuel supply pipe 11 downstream of the pressure-switching valve 4. As shown in FIG. 8, the check valve 6 has a valve member 17 received in a cylindrical housing 16 and a spring 18 urging the valve member 17 in its closing direction. This check valve 6 is constructed to open and allow a flow of fuel from the low-pressure common rail 7 to the fuel supply pipe 11 when the fuel pressure in the low-pressure common rail 7 rises above the sum of the fuel pressure in the fuel supply pipe 11 and the urging force of the spring 18. In FIG. 8, the reference numeral 19 denotes a spring receiving part and the reference numeral 16*a* a valve seat part.

In the fuel injection system of FIG. 7, until a fuel injection start time is reached, both the pressure-switching valve 4 and the closing valve 15 are kept closed, and the connection between the fuel injection valve 3 and the high-pressure common rail 2 and the connection between the pressure control chamber 3*a* and the fuel discharge conduit are cut off. In this state, due to the action of the orifice 5 and the check valve 6, the fuel in the fuel supply pipe 11 downstream of the pressure-switching valve 4 and the low-pressure fuel in the low-pressure common rail 7 are at the same pressure, and consequently low-pressure fuel from the fuel supply pipe 11 is supplied to the pressure control chamber 3*a* and the fuel chamber 3*b* of the fuel injection valve 3.

When the fuel injection start time is reached, the closing valve 15 is opened and fuel in the pressure control chamber 3*a* is discharged through the fuel discharge conduit. This causes a fuel pressure pushing a needle valve 3*c* in its closing direction to fall, and consequently the needle valve 3*c* is moved in its opening direction by the fuel pressure of the fuel chamber 3*b* against the urging force of a return spring 3*d* urging it in its closing direction, and the fuel injection valve 3 opens and a low-pressure initial injection (hereinafter, 'low-pressure injection'), wherein low-pressure fuel in the fuel chamber 3*b* is injected, is carried out. When the low-pressure injection period elapses, the pressure-switching valve 4 is opened and high-pressure fuel from the high-pressure common rail 2 is supplied through the fuel supply pipe 11 to the fuel chamber 3*b*, and a high-pressure main injection (hereinafter, 'high-pressure injection'), wherein high-pressure fuel is injected, is carried out following the low-pressure injection. Next, when an injection end time is reached, the closing valve 15 is closed and the connection between the pressure control chamber 3*a* and the fuel discharge conduit is cut off, the fuel pressure in the pressure control chamber 3*a* rises, the pushing force pushing the needle valve 3*c* in its closing direction increases, and the fuel injection valve 3 closes. Also, the pressure-switching valve 4 is closed, and high-pressure fuel in the fuel supply pipe 11 flows into the low-pressure common rail 7 through the orifice 5. When the fuel pressure in the low-pressure common rail 7 rises, the pressure control valve 8 is duty-controlled so that the fuel pressure in the low-pressure common rail 7 assumes a predetermined fuel pressure lower than that of the high-pressure fuel, and some of the fuel in the low-pressure common rail 7 is discharged to the fuel tank 10 as necessary.

In this way, the common rail fuel injection system 1 switches the fuel injection waveform from a low pressure to a high pressure by operating the pressure-switching valve 4 during the fuel injection period, i.e. the period for which the closing valve 15 is open, and in an initial stage of fuel injection, because a low-pressure injection is carried out, combustion is effected relatively slowly and the amount of NOx emissions in the exhaust gas is reduced. Also, because a high-pressure injection is being carried out at the end of fuel injection, the fuel injection rate falls rapidly as soon as the closing valve 15 closes, and the emission of smoke and particulates is reduced.

This common rail fuel injection system 1 of the related art includes the fuel supply pipe 11 extending between the fuel injection valve 3 and the pressure-switching valve 4 and the branch fuel pipe 12 extending between the fuel supply pipe 11 and the low-pressure common rail 7. Consequently, the fuel injection system 1 as a whole occupies a large space and has poor ease of mounting to the engine. In particular, when the fuel injection valve is to be mounted over the center of the combustion chamber on a four-valve/cylinder diesel engine having two intake valves and two exhaust valves per cylinder, the installation space for the fuel injector on the cylinder head 71 is narrow and it is essential for a fuel injector to be mounted on this kind of engine to be made compact.

Also, the lengths of the fuel supply pipe 11 and the branch fuel pipe 12 are long, and the internal volumes of the fuel supply pipe 11 and the branch fuel pipe 12 are large. Consequently, from when the pressure-switching valve 4 is opened to increase the injection pressure, it takes time for the fuel pressure in the fuel chamber 3*b* to rise from the low pressure to the high pressure, and also, from when the pressure-switching valve 4 is closed, it takes time for the fuel pressure in the fuel chamber 3*b* to reach the low pressure which is proper for the start of the next injection cycle. In other words, the passage sections shown with thick arrow lines in FIG. 7 constitute dead volume in fuel pressure control and impair the responsiveness of fuel pressure control.

One conceivable way of improving the responsiveness of fuel pressure control is to use an injection unit in which the fuel injection valve 3 and the pressure-switching valve 4 are integrated; however, in the fuel injection system 1 described above, high-pressure fuel passes through the pressure-switching valve 4 as the valve member of the pressure-switching valve 4 reciprocates, and when the fuel injection system 1 is used over a long period, the valve member and the valve seat of the pressure-switching valve 4 suffer wear and high-pressure fuel in the high-pressure common rail 2 tends to leak through the pressure-switching valve 4 to the fuel supply pipe 11 on the downstream side when the pressure-switching valve 4 is closed. That is, the pressure control function of the pressure-switching valve 4 is lost. In this case it is necessary for the pressure-switching valve 4 to be replaced, but in a fuel injection system wherein the fuel injection valve 3 and the pressure-switching valve 4 are simply integrated into an injection unit, even when there is no problem with the fuel injection valve 3, the whole injection unit has to be replaced, and labor time becomes long, the price of the replacement part becomes high, and as a result the repair cost is high.

Also, whereas, as has already been mentioned, it is desirable for the fuel flow passage volume of the fuel supply pipe 11 and the branch fuel pipe 12 extending between the fuel injection valve 3, the pressure-switching valve 4, the orifice 5 and the check valve 6, i.e., the dead volume of injection pressure control, to be minimized, in the check valve 6 of the related art fuel injection system 1, as shown in FIG. 8, the flow passage area of the spring receiving part 19 is considerably larger than the flow passage area of the valve seat part 16*a*, and thus the spring receiving part 19 constitutes another dead volume.

SUMMARY OF THE INVENTION

It is therefore an object of the present invention to provide a fuel injector having superior responsiveness of fuel pressure control and ease of mounting to an engine.

To achieve the above-mentioned object and other objects, a first fuel injector provided by the invention comprises a housing, mounted to a cylinder head of an engine; a fuel injection valve, fitted in a first end of the housing and having a first control valve for controlling fuel injection to a combustion chamber of the engine; a first conduit, formed in the housing and having one end connecting with the fuel injection valve and its other end opening in a second end of the housing and connected to a high-pressure fuel source storing high-pressure fuel; a second control valve, fitted to the housing, for controlling a supply of high-pressure fuel to the fuel injection valve by opening and closing the first conduit; a second conduit, formed in the housing and having one end connecting with the first conduit downstream of the second control valve and its other end opening in the housing and connected to a low-pressure fuel source storing low-pressure fuel at a lower pressure than the fuel pressure of the high-pressure fuel source; and a check valve, fitted in the housing and disposed to the second conduit, for allowing the inflow of low-pressure fuel from the low-pressure fuel source to the first conduit side.

In this first fuel injector provided by the invention, the second control valve, the check valve and the fuel injection valve are mounted to a housing and essentially are integrated with each other. Because of this, the first conduit and the second conduit connecting together the second control valve, the check valve and the fuel injection valve are formed in the housing, thereby the lengths of the first conduit and the second conduit can be made short; the fuel flow passage volume affecting the responsiveness of fuel pressure control when a low-pressure injection and a high-pressure injection are selectively carried out, i.e. dead volume, can be greatly reduced; and the responsiveness of fuel pressure control can be greatly increased. Also, the fuel injector as a whole becomes compact, and the mountability of the fuel injector to an engine improves. In the mounting of the second control valve, the check valve and the fuel injection valve to the housing, the respective main parts of the second control valve, the check valve and the fuel injection valve can for example be received in three holes formed in the housing. Further, the second control valve, the check valve and the fuel injection valve can be connected together in the housing by the first conduit and the second conduit having short lengths.

In a second fuel injector provided by the invention, the housing is mounted on the cylinder head with the first end of the housing positioned substantially over the center of the combustion chamber and the second end of the housing positioned radially outward of the combustion chamber, and the fuel injection valve, the check valve and the second control valve are so fitted in the housing that they form a substantially straight line in order from the first end of the housing to the second end thereof.

In this second fuel injector, because the fuel injection valve, the check valve and the second control valve are so fitted in the housing that they form a substantially straight line in order from the first end of the housing to the second end thereof, the housing becomes more compact and particularly the width dimension of the housing decreases.

In a third fuel injector provided by the invention, the external diameter of the check valve is smaller than the external diameter of the fuel injection valve and the external diameter of the second control valve, and the check valve is so fitted in the housing as to be positioned between an intake valve and an exhaust valve of the engine.

In this third fuel injector, because the housing is mounted to the cylinder head with the small-diameter check valve disposed between the fuel injection valve and the second control valve and positioned between an intake valve and an exhaust valve, the narrow installation space between an intake valve and an exhaust valve can be effectively utilized to install the housing fitted with the check valve, the fuel injection valve and the second control valve to the cylinder head. And, in order that the small-diameter check valve can be positioned between an intake valve and an exhaust valve, the width of that part of the housing may be made smaller than that of the other parts of the housing where the fuel injection valve and the second control valve are fitted, to further improve the mountability of the housing to an engine.

In a fourth fuel injector provided by the invention, the engine is a four-valves/cylinder engine having a rocker shaft disposed on one side of the combustion chamber, an intake rocker arm and an exhaust rocker arm are rotatably supported on the rocker shaft, and a pair of intake valves and a pair of exhaust valves are respectively disposed to each cylinder; the housing is mounted on the cylinder head in a space between the pair of intake valves and the pair of exhaust valves of the combustion chamber; and the housing is mounted on the cylinder head with the first end of the housing positioned substantially over the center of the combustion chamber and the second end of the housing positioned on the opposite side of the combustion chamber from the rocker shaft.

In this fourth fuel injector, the narrow installation space between a pair of intake valves and a pair of exhaust valves can be effectively utilized to install the housing fitted with the check valve, the fuel injection valve and the second control valve to the cylinder head. And, because the outer end of the housing is disposed so as to be positioned on the opposite side of the combustion chamber from the rocker shaft, the housing can be disposed efficiently on the cylinder head and the mountability of the housing to the cylinder head can thus be further improved.

In an eighth fuel injector provided by the invention, having the same basic construction as the first fuel injector, the second control valve is removably fitted in the housing and the second control valve has a control valve member and a valve member fitted to the control valve member, the valve member for closing the first conduit under a piston action pressure impressed by some of the high-pressure fuel from the high-pressure fuel source, and, when the piston action pressure is opened to the atmosphere, cancels the closing of the first conduit by the valve member and allows the inflow of high-pressure fuel from the high-pressure fuel source to the first conduit.

In this eighth fuel injector, because the second control valve is removably fitted in the housing receiving the fuel injection valve, the fuel injection valve and the second control valve are essentially integrated, and the first conduit for connecting the two becomes short. Consequently, the dead volume of fuel pressure control decreases and the responsiveness of fuel pressure control is improved. Also, the second control valve can be removed from the housing and the whole second control valve can be replaced or the valve member or a control valve body of the second control valve can be replaced. Accordingly, when there is no problem with the fuel injection valve, it is only necessary to remove and replace the second control valve, and the maintenance cost of the fuel injector decreases. And, the second control valve is a differential pressure actuation type which opens and closes in accordance with whether or not a piston action pressure is being impressed on its valve member, and compared to one of a type which on/off-controls the high-pressure fuel directly it is small and compared to a spool valve or the like it has less fuel leakage, and thus it contributes to making the fuel injector compact and to improving the precision of fuel pressure control.

In a ninth fuel injector provided by the invention, having the same basic construction as the first fuel injector, the check valve has a valve member, a spring urging the valve member in its closing direction, and a check valve body having a receiving space for receiving the valve member and the spring, and the check valve body has on an inner circumferential wall face thereof a convexity projecting toward the spring, and the convexity is so formed that, when the valve member moves toward the second conduit side against the urging force of the spring by an inflow of low-pressure fuel from the low-pressure fuel source to the second conduit, there remains an annular conduit between the convexity and the moved valve member.

In this ninth fuel injector, because a convexity is formed on the inner circumferential wall face of the check valve body, the volume of the space receiving the check valve, that is, the dead volume of fuel pressure control here, is smaller, and consequently the responsiveness of fuel pressure control is superior. In particular, the rise characteristic of the fuel pressure at the time of switching of the fuel pressure from a low pressure to a high pressure improves. As a result the freedom of injection rate waveform control increases, and this is effective in reducing exhaust gases.

Preferably the convexity is formed all the way around the inner circumferential wall face of the check valve, to achieve a maximal reduction in dead volume.

Also, in the ninth fuel injector, in carrying out fuel pressure control, during fuel injection the fuel pressure is switched from a low pressure to a high pressure by the second control valve being opened, and after fuel injection the fuel pressure in the fuel passages is lowered by the second control valve being closed. Here, when the second control valve is opened to switch from a low-pressure injection to a high-pressure injection, some high-pressure fuel flowing into the fuel passages from the high-pressure fuel source flows into the space receiving the check valve, and when the receiving space is filled with high-pressure fuel and the valve member of the check valve assumes its closed position this flow of high-pressure fuel ends.

Accordingly, in this fuel injector, because the volume of the space receiving the check valve, that is, the dead volume here, is small, the valve member of the check valve closes immediately after the second control valve opens. In other words, when the second control valve opens the fuel pressure in the first conduit and the second conduit rises rapidly, and consequently the rise gradient of the injection pressure from the low-pressure injection is large. This kind of fuel pressure rise characteristic particularly contributes an improvement of responsiveness pertaining to the switching from the low-pressure injection to the high-pressure injection.

In a tenth fuel injector provided by the invention, the check valve has a throttle portion, and the throttle portion is so formed extending in the axial direction of the valve member as to allow restrictively an inflow of fuel from the first conduit side to the low-pressure fuel source side.

In this tenth fuel injector, because after the fuel injection of a fuel injection cycle high-pressure fuel remaining in the fuel passage is fed back to the low-pressure fuel source through a throttle of the check valve and provides a fuel pressure, low-pressure fuel can be stored without the low-pressure fuel source being provided with pressurizing means.

BRIEF DESCRIPTION OF THE DRAWINGS

The present invention will become more fully understood from the detailed description given hereinafter and the accompanying drawing which are given by way of illustration only, and thus are not limitation of the present invention, and wherein.

DETAILED DESCRIPTION OF THE PREFERRED EMBODIMENTS

A preferred embodiment of a fuel injector according to the invention will now be described.

Figure 1:
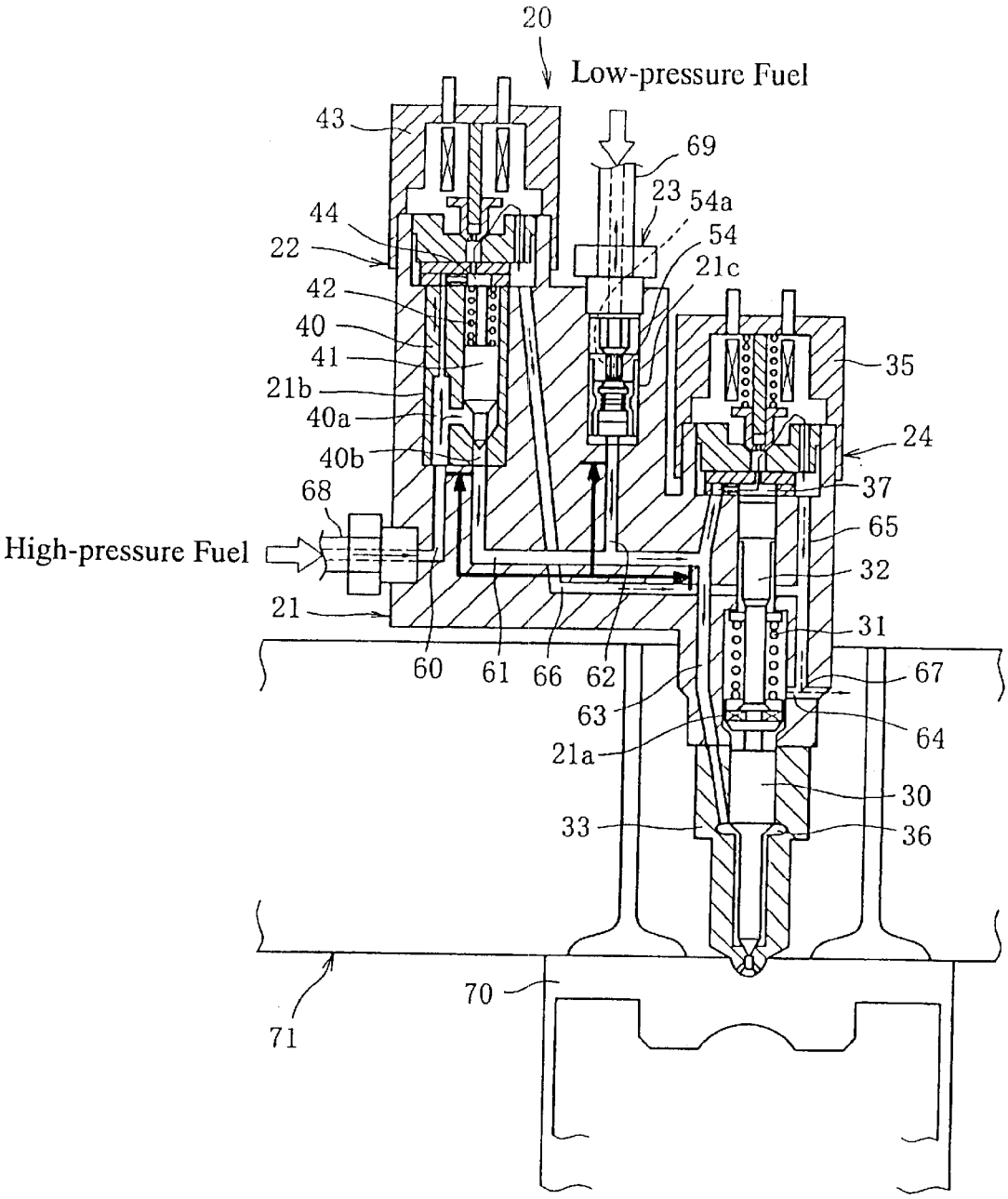
FIG. 1 is a sectional view of a preferred embodiment of a fuel injector according to the invention.
Figure 2:
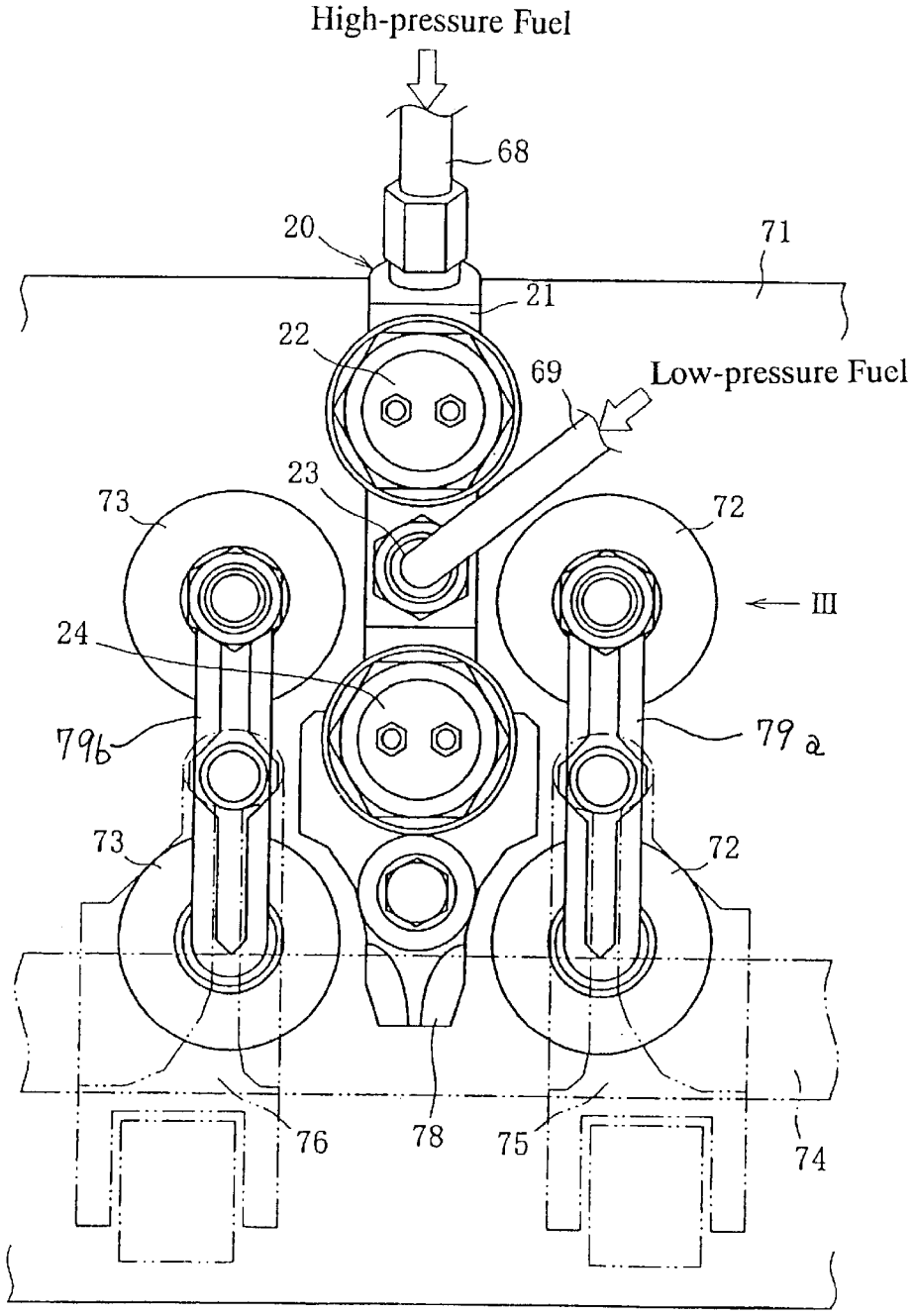
FIG. 2 is a plan view of the fuel injector shown in FIG. 1 in a state in which the fuel injector is mounted to the cylinder head of an engine.
Figure 3:
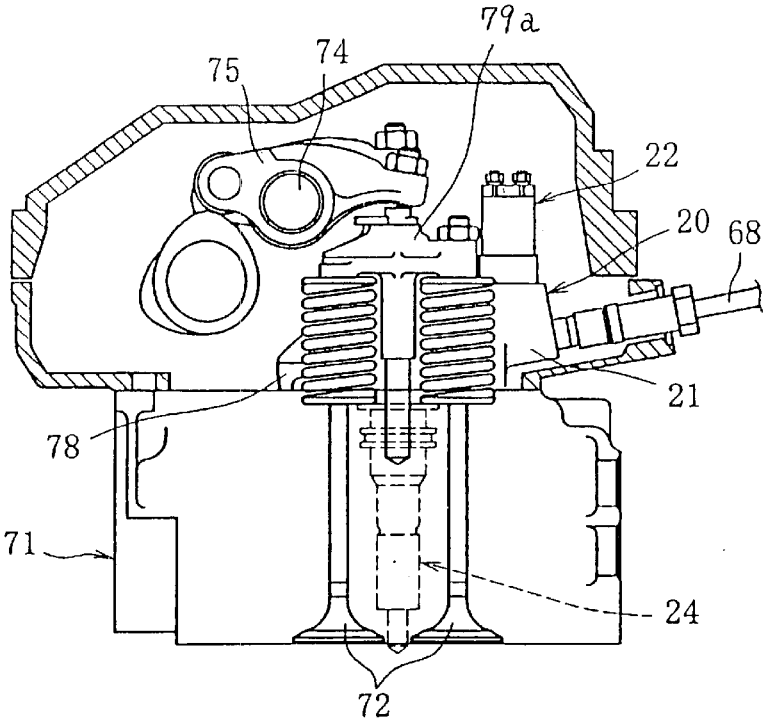
FIG. 3 is a detail sectional side view in the direction of the arrow III in FIG. 2.

As shown in FIG. 1 and FIG. 2, a fuel injector 20 has a fuel injection valve housing (hereinafter, 'housing') 21. A pressure-switching valve 22 (second control valve), a check valve 23 with a throttle and a fuel injection valve 24 are fitted in this housing 21, and by this means the pressure-switching valve 22, the check valve 23 and the fuel injection valve 24 are essentially integrated with each other. The check valve 23 is smaller in diameter than the pressure-switching valve 22 and the fuel injection valve 24. In the housing 21, the pressure-switching valve 22, the check valve 23 and the fuel injection valve 24 are each disposed vertically when seen in side view, as shown in FIG. 1. Also, they are so disposed in the housing 21 as to be positioned in a substantially straight line when seen in plan view, as shown in FIG. 2. The pressure-switching valve 22 and the fuel injection valve 24 are disposed at opposite ends of the housing 21, and the small-diameter check valve 23 with the throttle is disposed between the pressure-switching valve 22 and the fuel injection valve 24. As will be further discussed later, the fuel injector 20 of this preferred embodiment is mounted in a narrow mounting space between a pair of intake valves and a pair of exhaust valves on the cylinder head of a multi-valve diesel engine, and has been made compact as a whole to improve its mountability with respect to the engine. And in this connection, as shown in FIG. 2, the fuel injector 20 is formed in a shape such that a central part thereof is narrow. That is, the width dimension of the central part of the housing where the check valve 23 is fitted is smaller than the width dimensions of the end parts thereof where the pressure-switching valve 22 and the fuel injection valve 24 are fitted.

The housing 21 has formed therein first through third holes 21*a* through 21*c*, in which the pressure-switching valve 22, the check valve 23 and the fuel injection valve 24 are fitted, extending parallel with each other in the vertical direction of the housing 21. The second and third holes 21*b* and 21*c* are blind holes having their only openings at the top of the housing, while the first hole 21*a* is a through hole.

In the first hole 21*a*, which is provided at one end of the housing 21, an upper part of a needle valve 30, a spring 31 and a piston 32 of the fuel injection valve 24 are received. A nozzle holder 33 receiving a main part of the needle valve 30 has a hole aligned with the first hole 21*a* and is removably fitted to a bottom face of the housing 21. An electromagnetic closing valve 35 for injection timing control is removably fitted to the housing 21 above the piston 32. A pressure control chamber 37 is formed between the upper end face of the piston 32 and the closing valve 35.

A valve holder 40 of the pressure-switching valve 22 is removably fitted in the second hole 21*b*, which is provided at the other end of the housing 21. In this valve holder 40 a hole for receiving a valve member 41 and a spring 42 and fuel passages 40*a*, 40*b* each opening at the bottom face of the valve holder 40 are formed. The upper end of the fuel passage 40*b* forms a valve seat for the valve member 41 of the valve holder 40 and opens.

Figure 5:
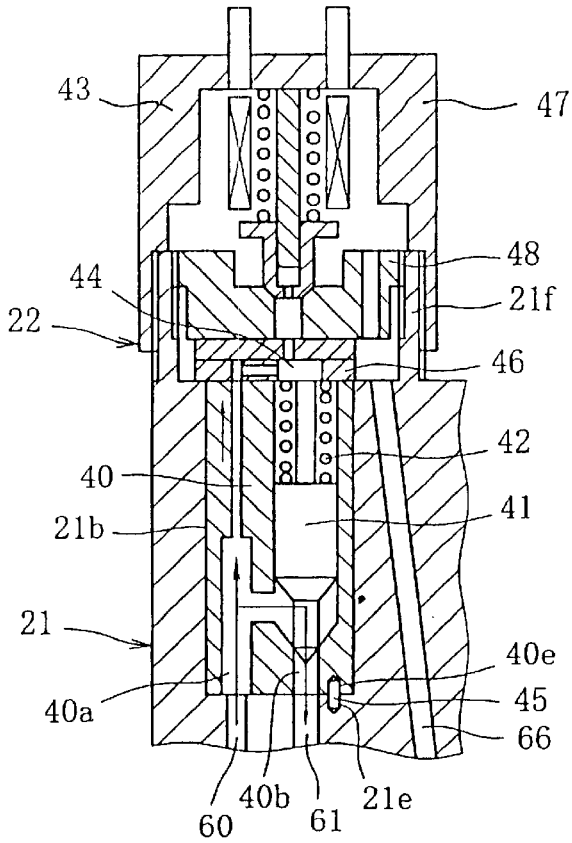
FIG. 5 is an enlarged view of a pressure-switching valve in a housing of the fuel injector.

As shown in FIG. 5, a hole 40*e* for positioning is provided in the bottom face of the valve holder 40 in alignment with a hole 21*e* for positioning formed in the housing 21. A positioning pin 45 fitted in these holes 21*e* and 40*e* positions the valve holder 40 in the second hole 21*b* of the housing 21 and aligns the fuel passages 40*a*, 40*b* of the valve holder 40 with fuel passages 60, 61 (first conduit) in the housing 21 respectively. The fuel passages 40*a*, 40*b*, 60 and 61 constitute a high-pressure fuel supply route from a high-pressure fuel source (not shown), preferably a high-pressure common rail (corresponding to the high-pressure common rail 2 of FIG. 7), to the fuel injection valve 24.

Above the valve holder 40, an electromagnetic valve 43 for pressure-switching valve opening/closing control is removably fitted to the housing 21, and this electromagnetic valve 43 forms a pressure control chamber 44 between itself and the upper end face of the valve member 41. The electromagnetic valve 43 has a case 47 and a holder 48, which functions as a valve seat of the electromagnetic valve 43. The holder 48 is formed with a threaded part around its periphery and is screwed into a threaded part formed around the inside of a flange 21*f* of the housing 21 and, by way of a seal member 46, fixes the valve holder 40 in the second hole 21*b* of the housing 21. By this means a seal is provided around the pressure control chamber 44. Also, the case 47 of the electromagnetic valve 43 has a threaded part formed around the inside of a lower part thereof and is screwed onto a threaded part formed around the outside of the flange 21*f*. By this means, the pressure-switching valve 22 and the electromagnetic valve 43 are removably mounted to the housing 21.

The check valve 23 with the throttle (hereinafter simply called a check valve) 23 is received in the third hole 21*c*, which is provided in the central part of the housing 21. The check valve 23 allows the inflow of low-pressure fuel from a low-pressure fuel source (not shown), preferably a low-pressure common rail (corresponding to the low-pressure common rail 7 of FIG. 7), to the fuel passage 61. The check valve 23 has a small-diameter hole, i.e., a throttle, which extends and penetrates in the axial direction of the check valve 23 and connects the low-pressure common rail with the fuel passage 61 when the check valve 23 is closed. This throttle has the function of restrictively allowing an inflow of fuel from the fuel passage 61 to the low-pressure common rail.

Figure 6:
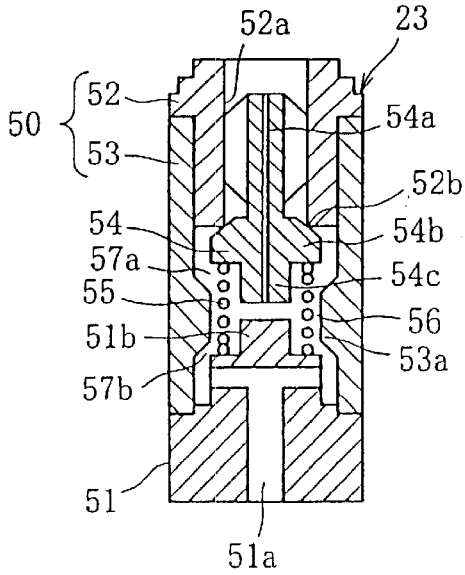
FIG. 6 is an enlarged view of a check valve with a throttle of the fuel injector.

As shown in FIG. 6, a main part of the check valve 23 is made up of a cylindrical housing 50, consisting of a base part 51, a top part 52 and a wall part 53, and a valve member 54 and a compression coil spring 55 received in this cylindrical housing 50. The base part 51, the top part 52 and the wall part 53 each consist of a hollow cylinder and together form a valve member and spring receiving space 56. The hollow centers of the base part 51 and the top part 52 respectively function as first and second passages 51*a*, 52*a*. The upper half of the valve member 54 is disposed in the hollow center of the top part 52, i.e. the second passage 52*a*, and the lower half of the valve member 54 is disposed in the valve member and spring receiving space 56. The compression coil spring 55 has an external diameter smaller than the external diameter of a seat part 54*b* of the valve member 54; it is disposed inside the valve member and spring receiving space 56 between a spring seat of the base part 51 and a spring seat of the valve member 54, and urges the valve member 54 in a direction in which it moves to close the valve. Under the urging force of the compression coil spring 55, the seat part 54*b* of the valve member 54 seats upon a valve seat 52*b* of the top part 52 and the check valve thus closes. When the pressure of low-pressure fuel in the low-pressure common rail exceeds the sum of the fuel pressure in the fuel passage 61 and the urging force of the compression coil spring 55, the valve member 54 lifts and the check valve opens, and low-pressure fuel flows into the fuel passage 61. Thus the valve member 54 is held movably between a valve-closing position and a valve-opening position.

The first passage 51*a* is connected to a branch passage 62 (second conduit) shown in FIG. 1, and the second passage 52*a* is connected by a pipe 69 shown in FIG. 1 to the low-pressure common rail. A small bore (hereinafter, 'orifice') 54*a* is formed in the valve member 54 as a throttle, and this orifice 54*a* extends and penetrates through the valve member 54 along its axis in the length direction. When the fuel pressure inside the fuel passage 61 exceeds the pressure of the low-pressure fuel in the low-pressure common rail, fuel in the fuel passage 61 flows through the branch passage 62, the orifice 54*a* and the pipe 69 to the low-pressure common rail.

In the check valve 23 of this preferred embodiment, from the point of view of raising the responsiveness of fuel pressure control in the fuel injector, the dead volume between the low-pressure common rail and the fuel passage 61 is reduced to a minimum. Specifically, on the inside of the wall part 53 of the check valve 23, a convexity 53*a* projecting radially inward is formed in the circumferential direction, preferably all the way around. In the length direction of the check valve, the section of the wall part 53 where the convexity 53*a* is formed is part-way along the compression coil spring 55, and the inner face of the convexity 53*a* faces the compression coil spring 55 across a small gap. The lower end of the convexity 53*a* forms between itself and the top end of the spring seat of the base part 51 an annular gap 57*b* serving as a fuel passage. The upper end of the convexity 53*a* forms between itself and the bottom end of the seat part 54*b* of the valve member 54 an annular gap 57*a* serving as a larger fuel passage than the annular gap 57*b* at the lower end of the convexity 53*a*. The convexity 53*a* is so provided that even when due to inflow of low-pressure fuel from the low-pressure common rail to the valve member and spring receiving space 56 the valve member 54 has most approached the base part 51 against the urging force of the compression coil spring 55, that is, even when the bottom part 54*c* of the valve member 54 abuts upon a stopper 51*b* of the base part 51, the upper end of the convexity 53*a* does not interfere with the lower end of the seat part 54*b* of the valve member 54 and close the annular gap 57*a*. Also, the dimensions and shape of the convexity 53*a* are such that the fuel flow passage area at the convexity 53*a* is not less than the fuel flow passage area at the valve seat 52*b* of the top part 52.

In this way, the check valve 23 provides a required fuel flow passage area when the valve is open while having a reduced volume of the valve member and spring receiving space 56, or dead volume. Also, because the valve member 54 is provided with an orifice 54*a* serving as a throttle, high-pressure fuel remaining in the fuel passage 61 after the fuel injection of each fuel injection cycle can be introduced into the low-pressure common rail via the orifice 54*a* to bring it to a predetermined fuel pressure, and it is not always necessary for pressurizing means to be provided for the low-pressure fuel source.

Further, the fuel passage for introducing high-pressure fuel to the low-pressure common rail can be made simple and small.

Referring again to FIG. 1, the housing 21 of the fuel injector is provided with fuel passages 60, 61, 62 and 63 and fuel discharge passages 64, 65 and 66. One end of the fuel passage 60, that is, the upper end, connects with the fuel passage 40*a* in the valve holder 40 received in the second hole 21*b* of the housing 21. The other end of the fuel passage 60, that is, the lower end, opens at an end face of the housing 21 and is connected by a pipe 68 to a high-pressure common rail serving as a high-pressure fuel source. The two ends of the fuel passage 63 connect with a fuel chamber 36 and the pressure control chamber 37 of the fuel injection valve 24. One end of the fuel passage 61 connects with the fuel passage 40*b* of the valve holder 40 received in the second hole 21*b* of the housing 21, and the other end of the fuel passage 61 connects with a middle part of the fuel passage 63. One end of the fuel passage 62, serving as a branch passage, connects with a middle part of the fuel passage 61, and the other end of the branch passage 62 is connected to the check valve 23 received in the third hole 21*c* of the housing 21. Fuel discharged from the fuel injection valve 24, the closing valve 35 and the electromagnetic valve 43 passes through the fuel discharge passages 64, 65 and 66 and collects at a discharged fuel confluence part 67 and then is returned to a fuel tank (corresponding to the fuel tank 10 of FIG. 7).

In the fuel injector of this preferred embodiment, the pressure-switching valve 22, the check valve 23 and the fuel injection valve 24 are housed integrally and close to each other in the housing 21. Consequently, the lengths of the fuel passages 61, 62 connecting these elements 22 through 24 together are short, and the capacity of the fuel passages 61, 62, i.e. dead volume (shown with thick arrow lines in FIG. 1), greatly decreases.

Also, the pressure-switching valve 22, the check valve 23 and the fuel injection valve 24 are disposed in the housing 21 in positions on a substantially straight line in this order from the high-pressure fuel source side, and the fuel passages 61 through 63 connecting these elements 22 through 24 together are disposed in order. Consequently, the construction of the fuel passages 60 through 63 from the high-pressure fuel source to the fuel injection valve 24 becomes simple and the formation of these fuel passages is relatively easy. Also the fuel discharge passages 64 through 66 are combined and the fuel discharge system is thereby simplified.

This fuel injector 20 is fitted to the cylinder head 71 of a multiple-valves engine for example a four-valves/cylinder diesel engine. This engine has intake side and exhaust side rocker arms 75, 76 rockably supported by a rocker arm shaft 74. A pair of intake valves 72 are opened and closed by rocking of the rocker arm 75 accompanying rotation of a camshaft together with the action of valve bridge 79*a*, and a pair of exhaust valves 73 are opened and closed by rocking of the rocker arm 76 together with the action of valve bridge 79*b*.

In the mounting of the fuel injector 20 to the cylinder head 71 the fuel injection valve 24 is disposed in a substantially central position over a combustion chamber 70 (FIG. 1) and the check valve 23 is disposed between one of the intake valves 72 and the exhaust valve 73 facing it. And, in a direction perpendicular to the rocker arm shaft 74, the pressure-switching valve 22 is positioned between the intake and exhaust valves 72, 73 on the opposite side from the rocker arms 75 and 76, away from the rocker arm shaft 74. The part of the fuel injector 20 around the first hole 21*a* in which the fuel injection valve 24 is fitted is fixed to the cylinder head 71 by a nozzle bridge 78 serving as a fixing member.

By the fuel injector 20 being fitted to the cylinder head 71 with the check valve 23 positioned in the narrow space between an intake valve 72 and an exhaust valve 73 of the engine in this way, the narrow mounting space above the cylinder head 71 is utilized effectively.

The fuel passage 60 on the upstream side of the pressure-switching valve 22 in the housing 21 is connected by the pipe 68 to the high-pressure common rail, and the check valve 23 is connected by the pipe 69 to the low-pressure common rail.

The action of the fuel injector 20 of this preferred embodiment will now be described.

Figure 7:
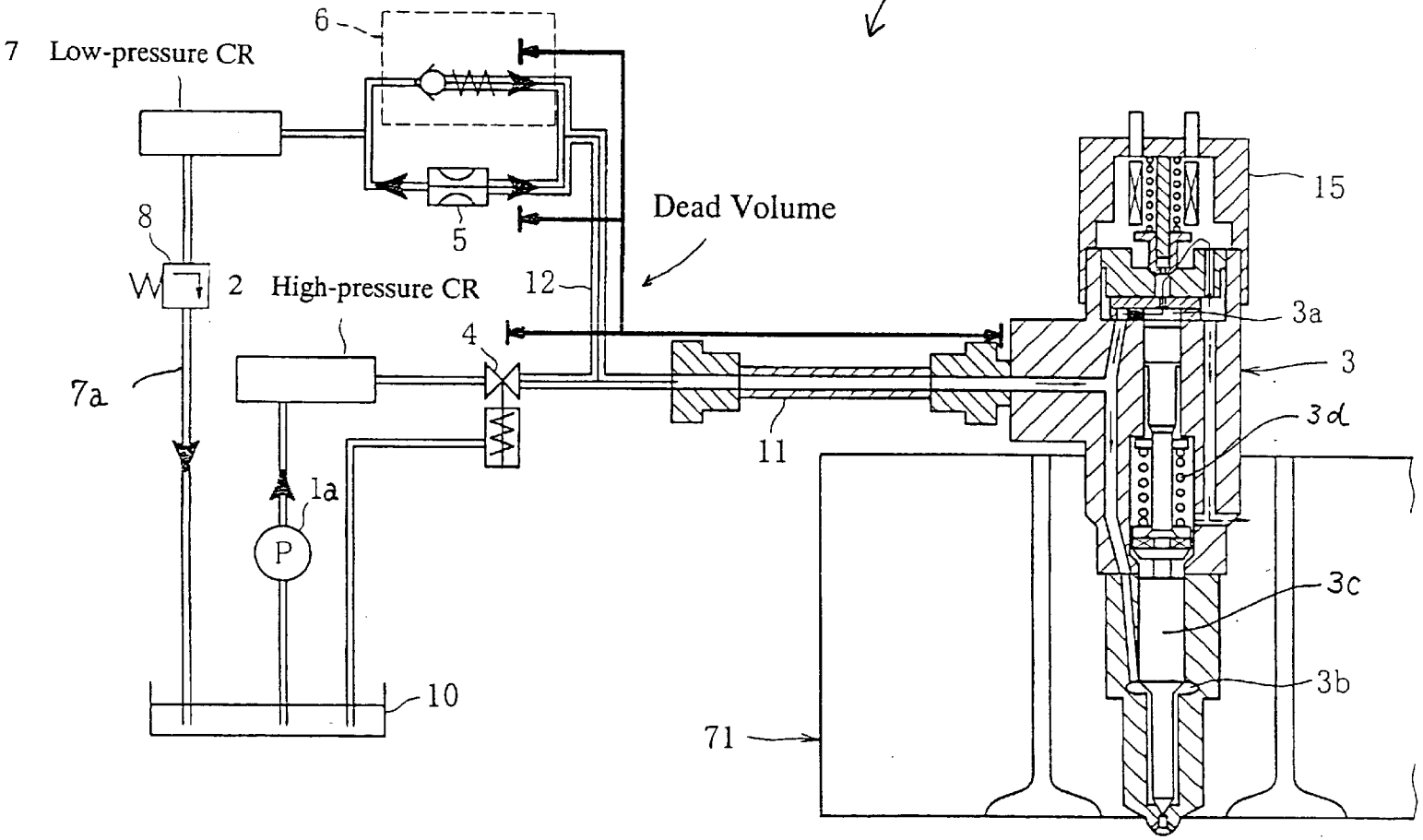
FIG. 7 (Prior Art)
FIG. 7 is a construction view of a common rail type fuel injection system of related art.
Figure 8:
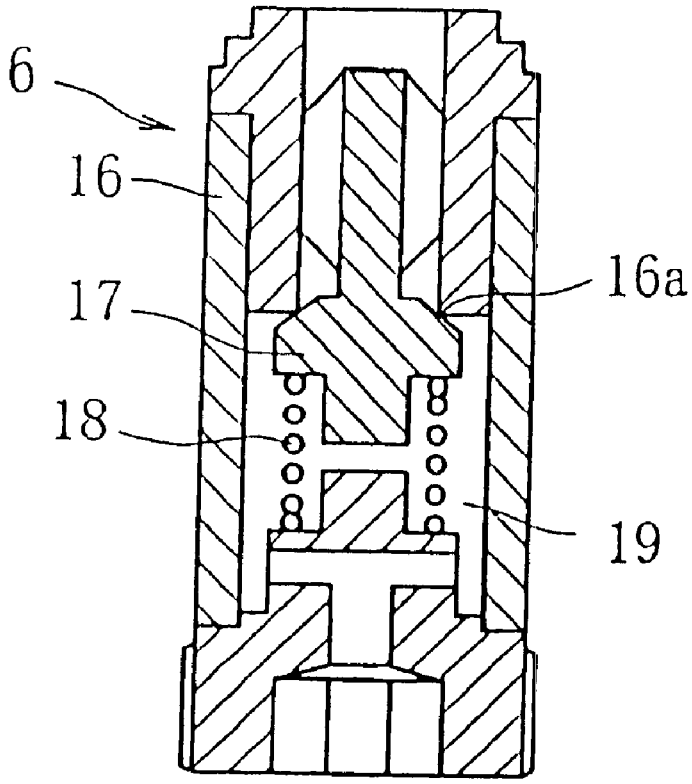
FIG. 8 (Prior Art)
FIG. 8 is a sectional view of a check valve in the common rail type fuel injection system shown in FIG. 7.

The operation of the fuel injector 20 is basically the same as that of the related art fuel injection system already described with reference to FIG. 7.

In each fuel injection cycle of the fuel injector 20, until a fuel injection start time is reached, the pressure-switching valve 22 and the closing valve 35 for fuel injection timing control (first control valve) are kept closed. In this state, when the fuel pressure in the fuel passage 62 downstream of the check valve 23 exceeds the pressure of the low-pressure fuel in the low-pressure common rail, fuel in the fuel passage 62 flows through the orifice 54*a* of the check valve 23 into the low-pressure common rail.

When on the other hand the pressure of the low-pressure fuel on the low-pressure common rail side exceeds the fuel pressure in the fuel passage 62, the check valve 23 opens and low-pressure fuel flows into the fuel passage 62. As a result, the fuel in the fuel passages 61, 63 on the downstream side of the pressure-switching valve 22 assumes the same pressure as the low-pressure fuel. And thus low-pressure fuel acts on the fuel chamber 36 and the pressure control chamber 37 of the fuel injection valve 24.

When the fuel injection start time is reached, the closing valve 35 opens and low-pressure fuel is discharged from the pressure control chamber 37, the pressure of the low-pressure fuel in the fuel chamber 36 rises above the sum of the fuel pressure in the pressure control chamber 37 and the urging force of the spring 31, and as a result the needle valve 30 lifts and the fuel injection valve 24 opens and a low-pressure injection is carried out.

When a low-pressure injection period elapses, a drive current is passed through a solenoid of the electromagnetic valve 43 of the pressure-switching valve 22, and the valve member of the electromagnetic valve 43 is electromagnetically attracted to the solenoid side and lifts. That is, the electromagnetic valve 43 opens, fuel in the pressure control chamber 44 of the pressure-switching valve 22 consequently is discharged through the exhaust passage 66, and the fuel pressure in the pressure control chamber 44 falls. High-pressure fuel from the high-pressure common rail passes through the fuel passage 60 and flows into the passage 40*a* at all times, but because the upper part of the passage 40*a*, which connects with the pressure control chamber 44, is small in diameter and has a high flow passage resistance, when the electromagnetic valve 43 opens, most of the high-pressure fuel supplied from the high-pressure common rail to the passage 40*a* flows into a fuel reservoir around the bottom of the valve member 41. This high-pressure fuel acts as a piston action pressure on the bottom of the valve member 41, and the valve member 41 is pushed up against the resistance of the spring force of the spring 42. In other words, the pressure-switching valve 22 opens. As a result, high-pressure fuel from the high-pressure common rail is supplied through the fuel passages 40*b*, 61 and 63 to the fuel chamber 36 and the pressure control chamber 37 of the fuel injection valve 24, and a high-pressure injection is carried out.

When an injection end time is reached, the closing valve 35 closes and the fuel pressure in the pressure control chamber 37 rises, the needle valve 30 seats under the fuel pressure of this high-pressure fuel and the urging force of the spring 31 and the fuel injection valve 24 thus closes, and the fuel injection ends. After that, the electromagnetic valve 43 is closed and consequently the fuel pressure in the pressure control chamber 44 of the pressure-switching valve 22 rises and the pressure-switching valve 22 closes.

After the pressure-switching valve 22 closes, high-pressure fuel in the fuel passages 61 through 63 flows through the orifice 54*a* of the check valve 23 into the low-pressure common rail.

In this way, in each fuel injection cycle, a low-pressure injection and a high-pressure injection are carried out. To effect this kind of fuel injection exactly with the required pressures and in the required times, particularly at high engine speeds, it is necessary for the fuel pressure in the fuel passages 61, 62 to be raised rapidly from a low pressure to a high pressure at the time of switching from the low-pressure injection to the high-pressure injection, and it is also necessary for the fuel pressure in the fuel passages 61, 62 to be lowered from a high pressure to a low pressure between the end of the high-pressure injection and the start of the next low-pressure injection.

Figure 4:
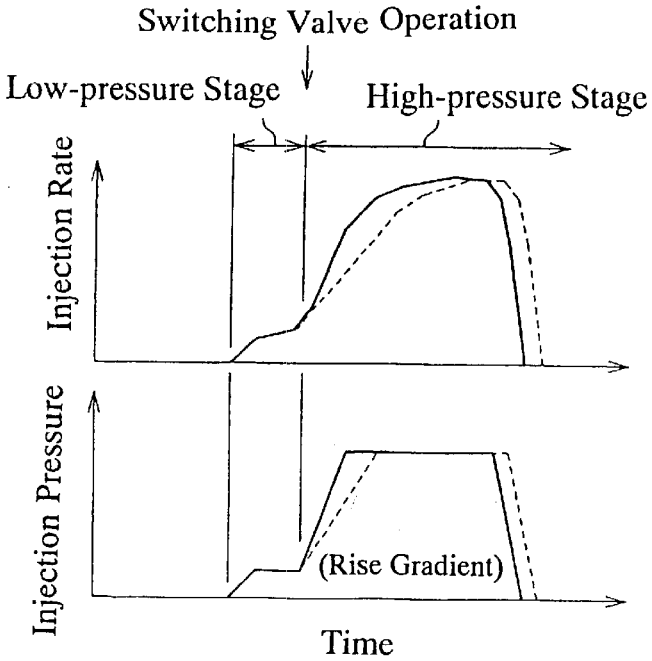
FIG. 4 is a view showing an example of a fuel injection waveform obtained with the fuel injector of FIG. 1.

In this connection, in the fuel injector 20, as explained above, the lengths of the fuel passages 61, 62 connecting together the pressure-switching valve 22, the check valve 23 and the fuel injection valve 24 are short and their internal volumes are small. Because of this, the residence time of fuel in the fuel passages 61, 62 is short and an increase in the pressure in the fuel passages 61, 62 can be effected rapidly on switching of the injection pressure. In other words, with the fuel injector 20, the dead volume impairing the responsiveness of fuel pressure control is small, and, as shown by a fuel injection waveform indicated by the solid lines in FIG. 4, compared to the case of a related art fuel injector, shown with broken lines in FIG. 4, the responsiveness of fuel pressure control is excellent.

Furthermore, because a convexity 53*a* is provided on the inside of the wall part 53 of the check valve 23 and the volume of the valve member and spring receiving space 56 of the check valve 23 is small, the responsiveness of fuel pressure control is improved in this way also, and in particular the rise characteristic of the high-pressure injection is improved. That is, on switching from the low-pressure injection to the high-pressure injection, some of the high-pressure fuel flowing into the fuel passage 61 immediately after the pressure-switching valve 22 opens is consumed in closing the check valve 23. In other words, the check valve 23 closes completely only after its valve member and spring receiving space 56 is filled with high-pressure fuel. And thus the volume of the valve member and spring receiving space 56 is dead volume; however, with the fuel injector 20, wherein a check valve 23 in which this dead volume is small is used, as a result of this construction, compared to the fuel injection waveform of the solid line in FIG. 4, which illustrates the effect of the dead volume of the fuel passages 61, 62 being reduced, the rise characteristic of the high-pressure injection can be improved still further.

Because the rise gradient of the injection pressure immediately after the switching of the injection pressure from the low pressure to the high pressure can be made steeper like this, by adjusting the opening characteristic of the pressure-switching valve 22 it is possible to control the rise gradient of the injection pressure over a wide range from gentle to sharp. As a result, the freedom of injection rate waveform control increases, and a contribution is thereby made to exhaust gas reduction.

It will now be explained how the valve member 41 and the valve holder 40 of the pressure-switching valve 22 are replaced when they have become worn. First the electromagnetic valve 43, the holder 48 and the seal member 46 are removed from the housing 21, and then the valve holder 40 is removed from the second hole 21*b* of the housing 21. When replacing a worn valve member 41, the worn valve member 41 is removed from the valve holder 40. Then, a valve holder 40 fitted with a new valve member 41 or a new valve holder 40 is inserted into the second hole 21*b* of the housing 21 and by the valve holder 40 being positioned in the second hole 21*b* by means of the positioning pin 45 the fuel passages 40*a*, 40*b* of the valve holder 40 are correctly connected with the fuel passages 60, 61 of the housing 21. The seal member 46 is then placed on the valve holder 40; the holder 48 is screwed into the flange 21*f* of the housing 21, whereby the valve holder 40 is fixed in the second hole 21*b* of the housing 21; and the electromagnetic valve 43 is fitted to the flange 21*f*. Thus repair or replacement of the pressure-switching valve 22 can be carried out with only the pressure-switching valve 22 having to be removed from the housing 21, and because of this, compared to a construction such that replacement of the check valve 23 or removal of the housing 21 is unavoidable when repairing or replacing the pressure-switching valve 22, repair costs are lower.

The invention being thus described, it will be obvious that the same may be varied in many ways. Such variation are not to be regarded as a departure from the spirit and scope of the invention, and all such modification as would be obvious to one skilled in the art are intended to be included within the scope of the following claims.

What is claimed is:

1. A fuel injector, comprising:

a housing mounted on a cylinder head of an engine;

a fuel injection valve fitted in a first end of the housing, the fuel injection valve having a first control valve for controlling fuel injection to a combustion chamber of the engine;

a first conduit formed in the housing, the first conduit having one end connecting with the fuel injection valve and its other end opening in a second end of the housing and connected to a high-pressure fuel source storing high-pressure fuel;

a second control valve fitted in the housing, the second control valve controlling a supply of high-pressure fuel to the fuel injection valve by opening and closing the first conduit;

a second conduit formed in the housing, the second conduit having one end connecting with the first conduit downstream of the second control valve and its other end opening in the housing and connected to a low-pressure fuel source storing low-pressure fuel at a lower pressure than the fuel pressure of the high-pressure fuel source; and a check valve fitted in the housing, the check valve being interposed between the second conduit and the low-pressure fuel source and allowing the inflow of low-pressure fuel from the low-pressure fuel source to the first conduit side, wherein the second control valve is removably fitted in the housing and the second control valve has a control valve member and a valve member fitted to the control valve member, the valve member for closing the first conduit under a piston action pressure impressed by some of the high-pressure fuel from the high-pressure fuel source, and, when the piston action pressure is opened to the atmosphere, cancels the closing of the first conduit by the valve member and allows the inflow of high-pressure fuel from the high-pressure fuel source to the first conduit.

2. A fuel injector, comprising:

a housing mounted on a cylinder head of an engine;

a fuel injection valve fitted in a first end of the housing, the fuel injection valve having a first control valve for controlling fuel injection to a combustion chamber of the engine;

a first conduit formed in the housing, the first conduit having one end connecting with the fuel injection valve and its other end opening in a second end of the housing and connected to a high-pressure fuel source storing high-pressure fuel;

a second control valve fitted in the housing, the second control valve controlling a supply of high-pressure fuel to the fuel injection valve by opening and closing the first conduit;

a second conduit formed in the housing, the second conduit having one end connecting with the first conduit downstream of the second control valve and its other end opening in the housing and connected to a low-pressure fuel source storing low-pressure fuel at a lower pressure than the fuel pressure of the high-pressure fuel source; and a check valve fitted in the housing, the check valve being interposed between the second conduit and the low-pressure fuel source and allowing the inflow of low-pressure fuel from the low-pressure fuel source to the first conduit side, wherein the check valve has a valve member, a spring urging the valve member in its closing direction, and a check valve body having a receiving space for receiving the valve member and the spring, and the check valve body has on an inner circumferential wall face thereof a convexity projecting toward the spring, and the convexity is so formed that, when the valve member moves toward the second conduit side against the urging force of the spring by an inflow of low-pressure fuel from the low-pressure fuel source to the second conduit, there remains an annular conduit between the convexity and the moved valve member.

3. A fuel injector according to claim 2, wherein the check valve has a throttle portion, and the throttle portion is so formed extending in the axial direction of the valve member as to allow restrictively an inflow of fuel from the first conduit side to the low-pressure fuel source side.

4. A fuel injector, comprising:

a housing mounted on a cylinder head of an engine;

a fuel injection valve fitted in a first end of the housing, the fuel injection valve having a first control valve for controlling fuel injection to a combustion chamber of the engine;

a first conduit formed in the housing, the first conduit having one end connecting with the fuel injection valve and its other end opening in a second end of the housing and connected to a high-pressure fuel source storing high-pressure fuel;

a second control valve fitted in the housing, the second control valve controlling a supply of high-pressure fuel to the fuel injection valve by opening and closing the first conduit;

a second conduit formed in the housing, the second conduit having one end connecting with the first conduit downstream of the second control valve and its other end opening in the housing and connected to a low-pressure fuel source storing low-pressure fuel at a lower pressure than the fuel pressure of the high-pressure fuel source; and a check valve fitted in the housing, the check valve being disposed to the second conduit and allowing the inflow of low-pressure fuel from the low-pressure fuel source to the first conduit side.

5. A fuel injector according to claim 4, wherein:

the housing is mounted on the cylinder head with the first end of the housing positioned substantially over the center of the combustion chamber and the second end of the housing positioned radially outward of the combustion chamber; and the fuel injection valve, the check valve and the second control valve are so fitted in the housing that they form a substantially straight line in order from the first end of the housing to the second end of the housing.

6. A fuel injector according to claim 5, wherein:

the external diameter of the check valve is smaller than the external diameter of the fuel injection valve and the external diameter of the second control valve; and the check valve is so fitted in the housing as to be positioned between an intake valve and an exhaust valve of the engine.

7. A fuel injector according to claim 4, wherein:

the engine is a four-valves/cylinder engine having a rocker shaft disposed on one side of the combustion chamber, an intake rocker arm and an exhaust rocker arm are rotatably supported on the rocker shaft, and a pair of intake valves and a pair of exhaust valves are respectively disposed to each cylinder;

the housing is mounted on the cylinder head in a space between the pair of intake valves and the pair of exhaust valves; and the housing is mounted on the cylinder head with the first end of the housing positioned substantially over the center of the combustion chamber and the second end of the housing positioned on the opposite side of the combustion chamber from the rocker shaft.

8. A fuel injector according to claim 4, wherein:

the second control valve is removably fitted in the housing; and the second control valve has a control valve member and a valve member fitted to the control valve member, the valve member for closing the first conduit under a piston action pressure impressed by some of the high-pressure fuel from the high-pressure fuel source, and, when the piston action pressure is opened to the atmosphere, cancels the closing of the first conduit by the valve member and allows the inflow of high-pressure fuel from the high-pressure fuel source to the first conduit.

9. A fuel injector according to claim 4, wherein:

the check valve has a valve member, a spring urging the valve member in its closing direction, and a check valve body having a receiving space for receiving the valve member and the spring; and the check valve body has on an inner circumferential wall face thereof a convexity projecting toward the spring, and the convexity is so formed that, when the valve member moves toward the second conduit side against the urging force of the spring by an inflow of low-pressure fuel from the low-pressure fuel source to the second conduit, there remains an annular conduit between the convexity and the moved valve member.

10. A fuel injector according to claim 9, wherein:

the check valve has a throttle portion, and the throttle portion is so formed extending in the axial direction of the valve member as to allow restrictively an inflow of fuel from the first conduit side to the low-pressure fuel source side.

* * * * *